United States Patent [19]

Shawhan et al.

[11] 4,298,970

[45] Nov. 3, 1981

[54] BOREHOLE ACOUSTIC TELEMETRY SYSTEM SYNCHRONOUS DETECTOR

[75] Inventors: E. Neil Shawhan, West Chester, Pa.; Octavio A. Vela; Miles A. Smither, both of Houston, Tex.

[73] Assignee: Sperry-Sun, Inc., Sugar Land, Tex.

[21] Appl. No.: 65,475

[22] Filed: Aug. 10, 1979

[51] Int. Cl.[3] ..... G01V 1/40; H04B 1/16

[52] U.S. Cl. ..... 367/82; 328/167; 333/173

[58] Field of Search ..... 367/82, 901; 370/29, 370/32, 84; 375/3, 4, 24; 330/132, 145, 284; 328/167; 333/173

[56] References Cited

U.S. PATENT DOCUMENTS

| | | | |
|---|---|---|---|
| 3,205,477 | 9/1965 | Kalbfell | 367/82 |
| 3,604,947 | 9/1971 | Puthuff | 333/173 |
| 3,668,570 | 6/1972 | Lautier et al. | 333/173 |
| 3,758,884 | 9/1973 | Bahler et al. | 328/167 |
| 3,761,816 | 9/1973 | Candon | 333/173 |
| 3,774,125 | 11/1973 | Candon et al. | 333/173 |
| 3,889,228 | 6/1975 | Shawhan | 367/82 |
| 3,904,970 | 9/1975 | Shawhan | 328/167 |
| 3,944,723 | 3/1976 | Fong | 340/147 T |
| 3,944,932 | 3/1976 | Fong | 455/307 |
| 4,017,812 | 4/1977 | Claudet et al. | 333/173 |
| 4,019.148 | 12/1977 | Shawhan | 328/167 |
| 4,127,824 | 11/1978 | Bennett | 328/167 |

FOREIGN PATENT DOCUMENTS 2245956 9/1972 Fed. Rep. of Germany ..... 333/173

OTHER PUBLICATIONS

Cleary, "Detecting Weak Light Signals", 6/67, pp. 841-842, Rev. Sci. Inst.

*Primary Examiner*—Nelson Moskowitz
*Attorney, Agent, or Firm*—M. Lee Murrah

[57] ABSTRACT

In a borehole telemetry system for acoustically transmitting data over a pipe suspended in a borehole, the level of noise in the data stream is inherently high, making the use of discrete frequencies advantageous to provide useful data. Any drift in electrical circuits which might affect or be affected by the use of precise frequencies is undesirable. A synchronous detector facilitates the removal of noise components from the data stream by comparing in a commutative filter the phase difference between a switching signal taken from the incoming data signal path, after the second stage of commutative filtering, with the data signal emerging from the last stage of filtering. The synchronous detector also compares a data signal having two stages of filtering with another data signal having six stages of filtering with the additional filtering, causing a phase shift in frequencies outside the precise frequency window, which the synchronous detector also rejects.

19 Claims, 8 Drawing Figures

BOREHOLE ACOUSTIC TELEMETRY SYSTEM SYNCHRONOUS DETECTOR

BACKGROUND OF THE INVENTION

This invention relates to acoustic telemetry in a borehole and more particularly to acoustically transmitting data over a pipe suspended in a borehole using precise frequencies of transmission. The problem of borehole telemetry has prevailed in the petroleum industry for a number of years. This problem has become increasingly crucial with the advent of deeper drilling, increased activity offshore, and rapidly escalating costs of drilling, all of which have brought about the requirements for drilling safer and less expensively. The acquisition of real time data from the bottom of a wellbore and in particular data associated with the parametric conditions of a drill bit offers the greatest potential for utilizing such a system. Recent increased attention to our energy needs has brought about the need for deeper drilling as well as increased activity in higher cost offshore and hostile environments. Basic drilling costs have escalated 150% in the last decade. These energy needs and escalating costs have focused attention on all potential methods to drill safer and cheaper. Of the possible methods, real time data from the drill bit offers the greatest potential to improved drilling efficiency and effectiveness in both exploration and production wells. The search for a reliable and economical method of obtaining information from the vicinity of the bit while drilling has been a goal ever since the advent of rotary drilling. Except in very special circumstances, however, previous attempts to develop real time measurewhile-drilling (MWD) systems have not met with success. Current technology is limited to surface evidence of drilling effectiveness. For example, measurements are presently made during drilling which include rotation rate, penetration rate, torque, etc. Also measured at the surface are the properties of the drilling fluid; i.e., weight, viscosity, etc. Systems are available to take the surface measurements and convert the information from analog to digital form, then process and display the parameters along with information inferred from them. Where experience is sufficient, these measurements may be used successfully in predicting problems such as abnormal formation pressure before a well control problem occurs. Lithology can also be inferred from certain types of measurements. However, the limitation remains that only surface information is available to infer conditions which may be far beneath the earth's surface.

Directional surveys of a borehole can be made presently by means of pump down or wireline tools. Here again, this is an after the fact measurement which requires significant interruption of the drilling process. Presently in commercial use are mud pulse systems for telemetering data from the bit vicinity to the surface, however, these systems are limited in their capability and application and as yet require the cessation of drilling.

There are basically four types of systems which show promise as communication and transmission techniques in a borehole telemetry system. These are mud pressure pulses, electromagnetic methods, insulated conductor or hardwire systems, and acoustic methods. Each of these systems has its advantages and disadvantages. The present application is concerned with an acoustical technique for transmitting signals through the drill pipe.

This system offers a high degree of reliability together with a rapid data rate, and the potential of low development and production costs. The greatest obstacle to the development of such a system has been the very low intensity of the signal which can be generated downhole, along with the acoustic noise generated by the drilling system resulting in a high ratio of noise to signal. In order to overcome these problems work has proceeded in the development of a system utilizing repeaters in the drill pipe string to help alleviate the signal attenuation problem. As the development of this system proceeds, it is apparent that the use of discrete frequencies falling into particular band widths is essential for the successful transmission of acoustic data on a drill pipe. Accordingly, every means possible must be utilized in order to increase the efficiency of such a system to realize successful data transmission. One of the problems encountered in working with discrete frequencies is that of drift in the system which effects the synchronous use of precise frequencies. For example, temperature stability of components is a major problem together with the high cost of more stable components. This is aggravated by the severe temperature range which is encountered in drilling a well far beneath the earth's surface. In addition, the deterioration of components causes changes in circuit operations which in a precision system present problems. Another factor to be considered is that of the replacement of system cmponents and the affect that such replacement would have on the alignment of the system in view of the precision required in the systems.

It is therefore an object of the present invention to provide a new and improved acoustic telemetry system having stable circuit systems to permit the use of precise frequencies.

SUMMARY OF THE INVENTION

With this and other objects in view, the present invention contemplates an acoustic telemetry system for use in a borehole environment and utilizing a synchronous detector having a phase shifting network including a commutative filter. The incoming data stream, which has passed through multiple stages of filtering, is phase shifted by a control signal which is also the data stream signal after some lesser amount of filtering. This results in a phase shift of noise in the data stream with the data component that is generating the switching signal for the synchronous detector.

Additionally, the commutative filter of the synchronous detector is of a multiplicity of two, which renders it effective to filter subharmonic frequencies of the center frequency.

Also, the comparison of the two signal paths, one having additional stages of filtering, produces a phase difference between frequencies outside the bandwidth of the filter and that of the center frequency and rejects the outside frequencies.

DETAILED DESCRIPTION OF THE DRAWINGS

DESCRIPTION OF THE PREFERRED EMBODIMENTS

Figure 1:
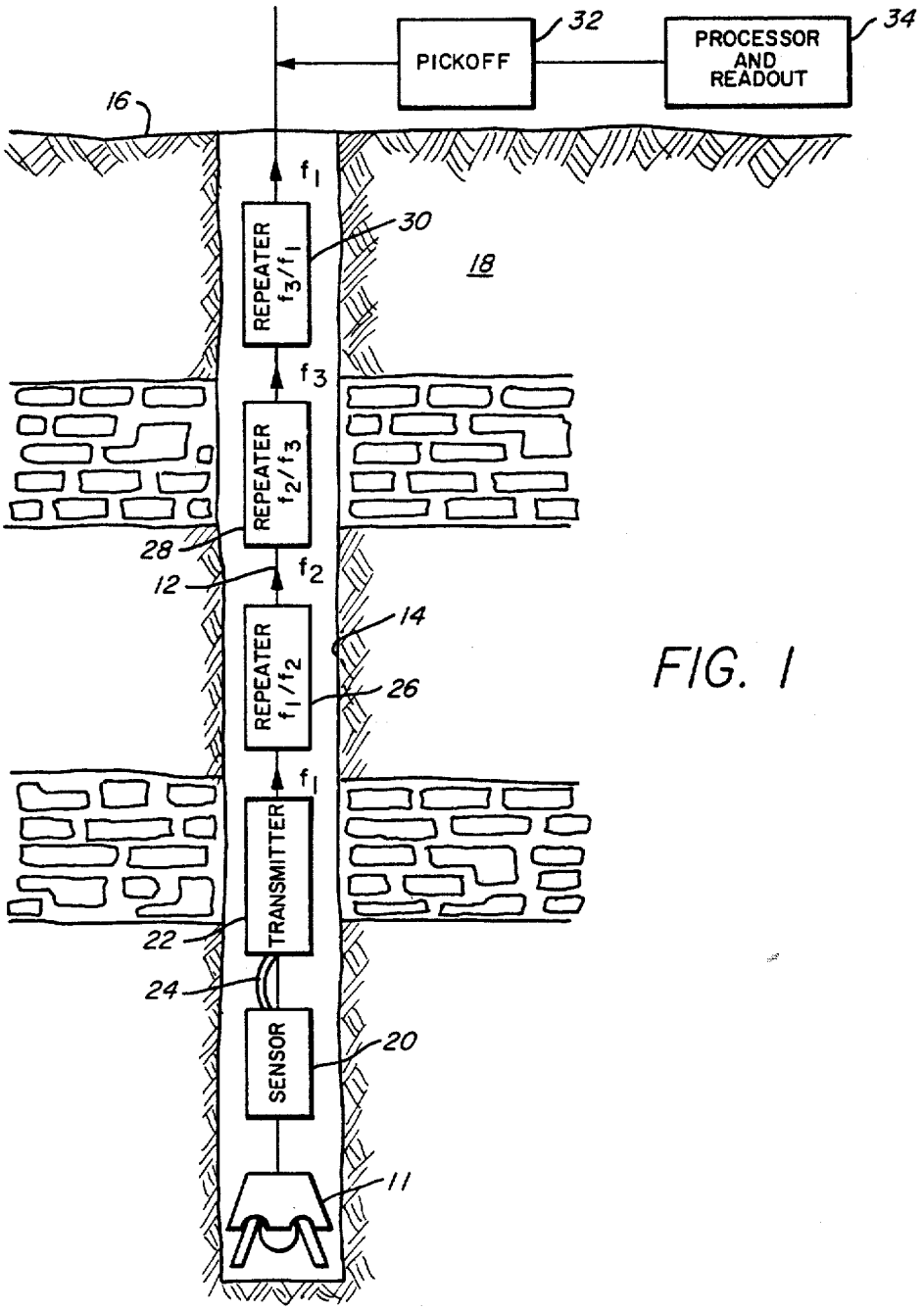
FIG. 1 is a schematic diagram of an acoustical telemetry system for use in boreholes.

The invention may be embodied in a borehole telemetry system as illustrated in FIG. 1. As schematically shown, the telemetry system is incorporated into a conventional drilling apparatus that includes a drill bit 11 in a drill stem 12 which are used to drill a borehole 14 from the surface 16 through earth formations 18. Information concerning parameters in a borehole is often desirable during drilling to plan further progression of the hole. This can be secured by a sensor 20 or similar device, in the drill string. Sensor 20 can, for example, be an orientation sensing device that provides information necessary for directional drilling. This type device would normally be placed in the drill string very near the drill bit 11.

Information generated by the sensor 20 is usually sent to the surface 16 where it can be evaluated and utilized. One transmission system useful for such purposes is an acoustic telemetry system that uses the drill string 12 as a transmission medium. The information is sent along the drill string 12 by an acoustical transmitter 22 which receives the information from nearby sensor 20 through an electrical conductor 24 or by other suitable means and methods of transmission.

The information is then encoded into an intelligible form that is compatible with a particular form of transmission chosen. The manner of such encoding and transmission is the subject of the present invention. Acoustical waves suffer attenuation with increasing distance from their source at a rate dependent upon the composition characteristics of the transmission medium. Many boreholes are so deep that signals sent by transmitter 22 will not reach the surface before they are attenuated to a level at which they are indistinguishable from noise present in the drill string. This problem is discussed in greater detail in co-pending application, Ser. No. 968,879.

In order that the signals reach the surface, they may have to be amplified several times. However, since acoustic waves travel in both directions along the drill string, some method is desirable that will ensure that the signals are received in only one direction. Otherwise, an amplifier would amplify signals coming from both above and below itself, rendering the system ineffective. One method that has been found suitable for producing directional isolation uses frequency shifts among three or more frequencies. Transmitter 22 starts the transmission process by transmitting the signal at a frequency $f_1$. A repeater 26 capable of receiving frequency $f_1$ is positioned in the drill string above transmitter 22. Repeater 26 retransmits the signal at frequency $f_2$ instead of frequency $f_1$.

The signal at frequency $f_2$ is sent along drill string 12 and is received by receiver 28 which is tuned to receive the signal at frequency $f_2$. Repeater 28 then transforms its signal to a frequency $f_3$ and retransmits it. The signal of frequency $f_3$ travels in both directions along the drill string 12, but it can be received only by repeater 30 which receives at $f_3$ and retransmits at $f_1$. The signal cannot be received by repeater 26 since it will receive only $f_1$. In this manner, directionality is assured using three frequencies if alternate repeaters are further apart than the distance necessary for the signal to attenuate to an undetectable level.

Figure 2:
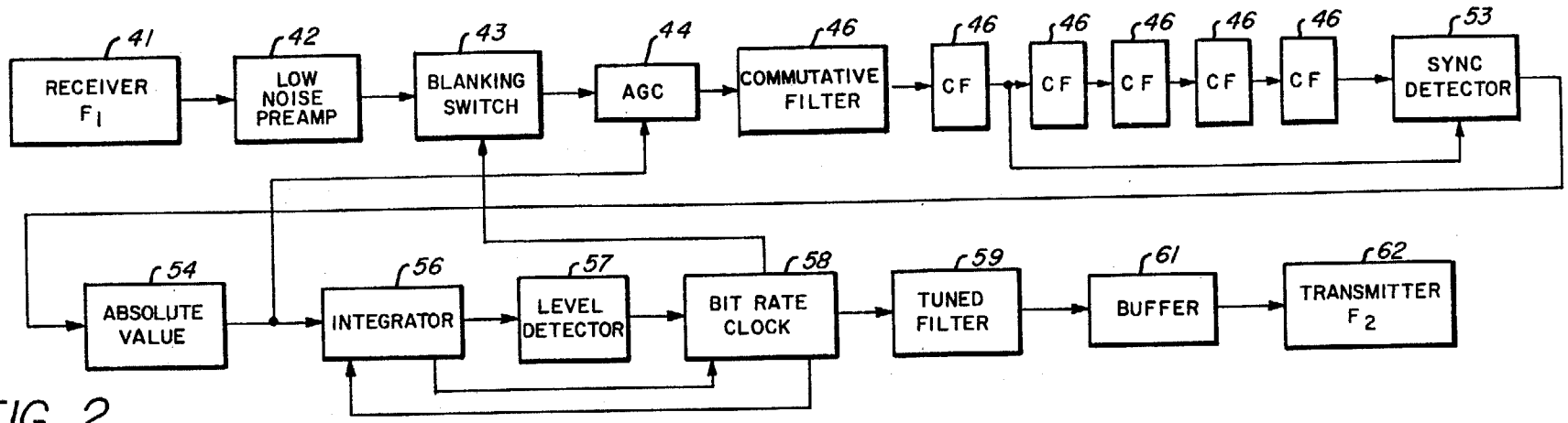
FIG. 2 is a schematic diagram of a receiving transmitting circuit for use in the present invention.

A sufficient number of repeaters to transmit the signal to the surface is used repeating the sequence estabilished by repeaters 26, 28 and 30 until the surface is reached. In FIG. 1, only three repeaters are shown, although a larger number may be used. In the system of FIG. 1, repeater 30 performs the final transmission to the surface at $f_1$. At the surface a pickoff 32, which includes a receiver similar to that used in the repeaters, detects the signal in the drill string 12. The pickoff sends the signal to a processor and readout device 34 which decodes the signal and places it in a useable form. Simplistically each repeater comprises a detector, a transmitter, and a disable network. (This will be described in greater detail with respect to FIG. 2.) It should be recognized that while the basic component comprises a repeater, the transmitter portion may be used separately and in substantially the same configuration as the transmitter of the repeater. In addition, the detector portion may similarly be used as a pickoff. Although the repeater such as 26 which is shown in greater detail in FIG. 2 is utilized for explanatory purposes, it's operation and construction is exactly the same as that for repeaters 28 and 30 with changes only to alter the receive and transmit frequencies. Referring to repeater 26 for illustrative purposes, a detector portion receives the signal at $f_1$ and reconstructs the original wave form, compensating for losses and distortion occurring during transmission through the drill pipe. Detection can be accomplished, for example, by means of a transducer such as a magnetostrictive or electrostrictive device. The reconstructed signal then enters a transmitter portion of the repeater where it is again applied to the transducer which may be the same or of a similar type as that of the detector. In order to prevent chatter which is analogous to oscillations in an analog network, the transmitter portion is operated only during times that the detector is not passing its received signal into the repeater circuit. As will be discussed in more detail in connection with FIG. 2, operation of the transmitter portion actuates a blanking switch which prevents the receiver portion from receiving the signal while the transmitting portion is transmitting.

The operation of a telemetry system as shown schematically in FIG. 1 is basically as follows: The sensor 20 develops an analog signal which is converted to a digital coding by means of an appropriate analog to digital conversion system. An example of a sensor to detect directional orientation of a drill bit is shown in U.S. Pat. No. 3,935,642. The signal may also be generated as pulse width data, or the like, which can also be converted to digital data for transmission in the system to be described. The sensor developed signal in any event is passed into an analog to digital conversion system which converts the analog signal to a digital code utilizing "1" and "0" for information transmission. This information is further processed or coded to permit data to be passed in the form of bits represented by "1's." Such "1's" are transmitted as sound pulses into the pipe. Systems for coding sound pulses for borehole telemetry in a similar manner are set forth in U.S. Pat. No. 3,930,220 and co-pending application Ser. No. 968,879. An oscillator is then operated at a fixed frequency and passes its output into a sound source. The sound source then converts the electrical energy into acoustical energy which is imparted to the pipe 12. By use of crystal controlled oscillators, the passage of data bits between alternate receivers and transmitters may be clocked in a precise manner. The system preferably activates the sound source only when a one data bit is passed, thus minimizing the use of power to drive the sound source. Power would then be used continuously only to operate clocking mechanisms and other low power consumption devices in the instrument.

After the acoustic signal is placed on the pipe string 12, it produces a compressional wave which travels in both directions on the pipe. The repeaters 26, 28 and 30 in the pipe string are spaced to receive the acoustic signal while it is strong enough to be readily detected, thus the system of repeaters function to detect "1's" and then retransmit a signal at a different frequency when activated by the acoustic signal which is indicative of a "1". More specifically, the repeater 26 includes an acoustical transducer or receiver coupled to the pipe which picks up the signal transmitted in the pipe at some discrete frequency; for example, X Hz. The transducer then converts the acoustic signal into an electrical signal which contains the transmitted frequency and any noise on the drill pipe. This signal is then fed to a system such as shown in FIG. 2 which filters the signal, reconditions it, and retransmits it at a different frequency; for example, $X+\Delta X$ Hz to the next uphole repeater, if the signal transmission is taking place in an uphole direction. It is here noted that this system may be utilized to transmit information from the surface to a downhole portion of the apparatus in order to control downhole functions from the surface.

Additional repeater sections 28 and 30 are utilized in the system depending on depth. If the depth of drilling, age of pipe, etc. dictates a system utilizing more than one repeater section, subsequent sections may be operated at other discrete frequencies as for example, $X+\Delta X$ Hz and $X+\Delta X$ Hz, alternating between the various frequencies. If sufficient spacing is allowed before repeating a transmitted frequency, natural attenuation of the signal will prevent stray signals from same frequency stations from being interpreted as current data signals. In this respect, it may not be necessary to retransmit from repeator sections at a different frequency, thus a single frequency may be utilized throughout the system. In any event, distance between repeaters and specific frequencies will be determined by signal loss and receiver signal lock on capability.

The repeated signal is again placed on the pipe string by a sound source as an acoustic signal which travels on the pipe to the next adjacent repeater section and eventually to a surface acoustic transducer or pickoff 32. Here the signal is amplified and converted from an acoustical signal into an electrical signal and the data is reconstructed to represent the detected downhole parameter.

Referring next to FIG. 2 of the drawings, a schematic diagram sets forth the components of a repeater section such as at 26, 28 and 30 of FIG. 1. The repeater includes a receiver section 41 comprised of an acoustic transducer for receiving an acoustic signal from the drill pipe and by means of the transducer converting it into an electrical signal. The received signal may be embedded in a high noise background. The transducer signal is passed to a low noise preamplifier 42 which, due to the low signal strength, is designed to provide as little circuit noise as possible. Preamp 42 has a high gain with its output being passed through a blanking switch 43 into AGC (Automatic Gain Control) circuit 44. The function of the blanking switch is to prevent the passage of signals into the circuit when a signal is being transmitted by the repeater.

Figure 5:
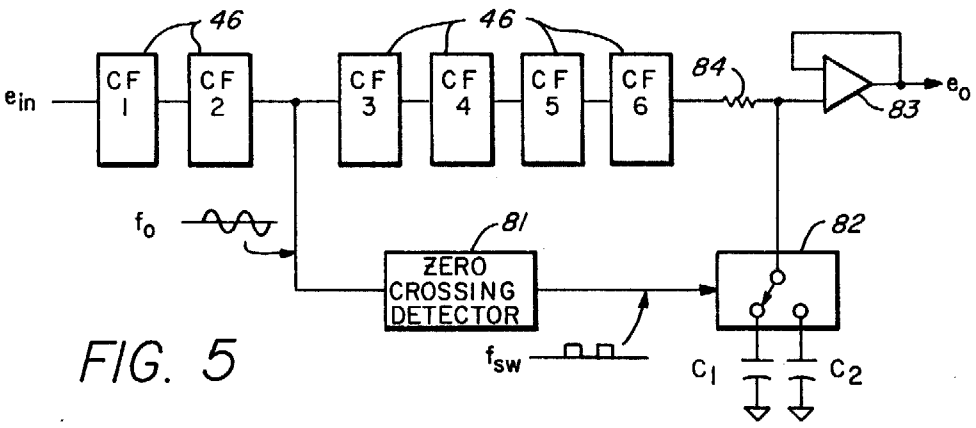
FIG. 5 is a more detailed schematic diagram of the sync detection circuit of FIG. 2.

The AGC circuit 44, which will be described in greater detail with respect to FIG. 5 is arranged to pass its output signal into a commutative filter section 46 comprised of six stages of commutative filters which are designed to filter out any noise or any signal that is outside the band that is being looked for. The output of the last stage of the commutative filter section is passed to a synchronous detector 53 which looks for a phase shift between the signal and outside the precise $f_0$. If noise is present with the signal within the band that is being observed, the noise will more than likely be out of phase with the signal. Such noise will be reduced by the synchronous detector. A switching signal for the synchronous detector is taken after the second section of commutative filtering so that some filtering has occurred on the switching signal and therefore the switching waveform is not dependent totally upon noise. The synchronous detector itself is also a commutative filter of multiplicity two as opposed to the other sections of the commutative filter which have a multiplicity of four. While the commutative filters will eliminate any noise or extraneous signals that are outside of the band that you are looking for, the filters pass noise at the same frequency as the signal. The purpose of the synchronous detector is to detect a difference in phase between the noise and the signal itself within the frequency window and use this phase difference to reduce the noise relative to the signal. The synchronous detector sees one signal having two stages of filtering and another signal having six stages of filtering. The additional filtering causes a phase shift in frequencies outside of $f_0$ which the synchronous detector rejects.

The output of the synchronous detector 53 is passed to an absolute value network 54 which takes the eye shaped wave form output of the synchronous detector and inverts the negative portion of the signal. The absolute value circuit 54 provides an output that is the absolute value of whatever input it receives. The output of the absolute value circuit 54 is passed back to the AGC 44 to provide a feedback control to the AGC circuit that has been filtered and synchronously detected. Such a feedback loop to the AGC that comes after filtering of the noise provides a gain control to the AGC that is set by a signal having a greater signal-to-noise ratio. The absolute value circuit 54 output is also passed to an integrator circuit 56 which is arranged to integrate during the time that it expects to receive a data bit and therefore the output of the integrator is the integrated value of the signal that is received. Since a great deal of filtering has occurred to the signal, the noise is low at this time and, if the integrator does not see a signal, it passes an integrated value of the noise which is low. With this in mind, the output of the integrator passes to a level detector 57 which is a clip circuit that looks for a signal above a certain threshhold and outputs a square wave, the width of which depends on the level of the integrator wave.

The output of the level detector 57 passes to a bit rate clock 58 which is terminology applied to a certain section of the circuitry because the primary end function of the section is to regenerate a clock which is representative of the bit rate that is present in the data stream. One function of the bit rate clock is to provide an all digital implementation for the synchronization circuitry, which is temperature insensitive as compared to an analog free running clock. An analog clock has problems with thermal stability and depends upon the initial tolerance of the components that are used to construct it. Components such as resistors and capacitors which have high thermal stability are very expensive and it therefore becomes uneconomical to provide components in the system that will develop the higher tolerances that are needed in a clock for use in a precision frequency instrument such as this. When a free running clock is used, the data stream must be used to correct a significant portion of the free running clock. In other words, a control signal must be developed from the data stream which is able to shift the frequency of the clock by a significant amount. The problem with this is that a false "1" or a noise burst in the data stream would pull the free running clock off frequency enough that is would cause the system to miss a true data bit coming in at a later time. The bit rate clock will be described in greater detail with respect to FIG. 8 of the drawings. However, it is mentioned at this time that the clock includes a local crystal oscillator which operates at substantially the same frequency as the transmitter clock that generated the data stream that is being received. Because the crystal used is a high tolerance and high stability device under changing temperature conditions, the two oscillators will be very close in frequency output and they will stay very close over a long period of time. Therefore, the synchronization circuitry of the bit rate clock only has to make small corrections by comparison to an analog clock in order to keep the two clocks fully synchronized at all times. This provides a very fine resolution of the signal and also means that a false signal or false "1" coming in the data stream will have very small likelihood of shifting the clocks out of synchronization.

An output of the bit rate clock is fed to the integrator circuit 56 to operate the integrator circuit in synchronization with the received incoming data stream. Since the bit rate clock has a local oscillator that is operated in synchronization with the transmitting oscillator, the bit rate clock knows when a received data bit should be coming in and so it operates the integrator to open a window within the system at a time when it is supposed to be receiving a data bit and then waits to see if a data bit is received or not. Assuming that there is data coming in during that time that the window is open, such data bit will have propogated through all of the filtering and through the level detector and into the bit rate clock. This refined signal then comes into the bit rate clock 58 as an output of the integrator by way of the integrator 56 going high and the level detector 57 detecting such high output of the integrator and sending it as a received "1" to the bit rate clock.

The bit rate clock then determines whether the received pulse has been received early or late, which information is passed back to the integrator 56 to shift the frequency window in response to the comparison made by the bit rate clock. The bit rate clock operates to continuously shift the window in very minute increments so that there is a continuous jittering affect going on between the bit rate clock and the integrator, with the overall affect being that the clock is fully synchronized to the clock controlling the transmitter.

Another portion of the bit rate clock 58 provides a fast search function. The purpose of the fast search is to synchronize the bit rate clock with the transmitter clock, particularly when the system is first powered, so that if the clocks are far out of synchronization it does not take a long period of time for the synchronization to be affected. The fast search mode forces the bit rate clock to search in only one direction if it does not see data for a certain period of time. This pushes the clock in one direction until the two clocks are synchronized. Then when data is being received, the bit rate clock ceases to function in the fast mode and returns to its normal mode of operation. An input to the bit rate clock directly from the integrator serves to provide this fast search function of the bit rate clock with the information that a valid data signal is being received and that the fast search need not continue to operate.

The bit rate clock is comprised of CMOS circuitry (complementary metal oxide semiconductor) to provide for the low power consumption that is desirable in the operation of borehole tools. The bit rate clock outputs a square wave signal of selected frequency which may be different than that received and which is one of three different frequencies coming from three different output oscillators in the bit rate clock section. This square wave output is passed to a tuned filter 59 which converts the square wave to a sine wave which in turn is passed to a buffer amplifier 61. The buffer 61 is a power driver amplifier which increases the signal to a level sufficient to drive the transmitter 62, which is an acoustic transducer, to place the frequency acoustically upon the drill pipe for transmission to the next receiving repeater or receiver.

Another output of the bit rate clock 58 passes to the blanking switch 43 which operates to interrupt reception of the incoming signal to the remaining circuitry so that when the output of the bit rate clock operates the oscillators for driving the transmitter 62, the resulting high level signal does not saturate the circuit just described.

Figure 3:
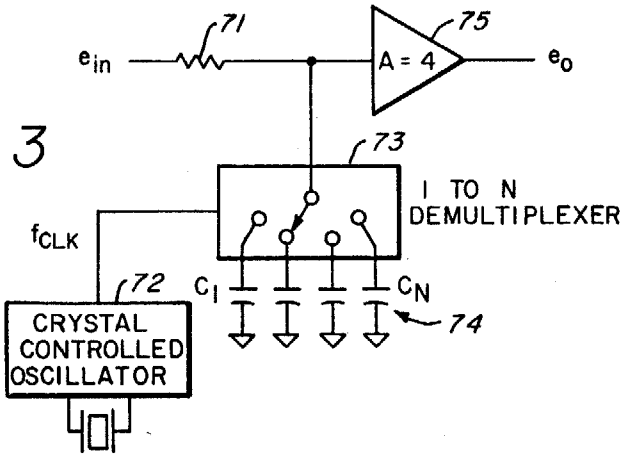
FIG. 3 is a more detailed schematic diagram of the commutative filter shown in FIG. 2.

Next referring to FIG. 3 of the drawings, a more detailed schematic representation of the commutative filters is shown. Such filters are particularly useful in the configuration described for providing the stability needed under varying temperature conditions to facilitate the precise and narrow band filtering desired in this system. An acoustic telemetry system based on amplitude shift keying requires a precise narrow band filter to discriminate between signal and noise. Conventional analog filters such as biquadratic sections can provide the required selectivity but the stability of such filters may not be adequate to meet the demands of borehole temperature extremes. The amplitude shift keyed signal is generated by a crystal controlled oscillator so that the required filter center frequency is known. The present invention makes use of this fact by controlling the center frequency of the commutative filter via a crystal controlled oscillator. The band width and selectivity are independently controlled by the RC time constant of each stage and the number of stages respectively. The commutative filter accurately and reliably establishes the center frequency of the receiver filter at the known frequency of the transmitter oscillator. This is done to within the tolerance of a crystal controlled oscillator independent of the drift (with temperature) of the passive and active components used in the filter.

Each section of the commutative filter is comprised of a 1 to n demultiplexer 73 which is clocked by a crystal controlled oscillator 72, with one oscillator being used to clock all sections of the commutative filter network. The band width and selectivity of the filter is determined by the RC time constant including the resistor 71 and the capacitor 74 of the demultiplexer. By setting resistor 71 at an optimum value we set up an RC time constant which allows the filter capacitors to charge to a useable level in as short a time as possible to give adequate averaging characteristics to the RC time constant. An amplifier 75 is provided in each stage to amplify the output signal of the filter. In the first two commutative filter sections of the system disclosed herein, the amplifiers have a gain other than unity and in the last four stages of the commutative filter section the amplifiers are unity gain amplifiers. The gains of the various sections can be other than those chosen for this particular application. As noise is progressively filtered out, the gain is increased without saturating the system with amplified noise. Thus, we can increase the gain as soon as some filtering is done so that we have a higher signal level to work with in the circuit. Then, after the first two stages of filtering, the signal level is high enough to use unity gain thereafter.

Figure 4:
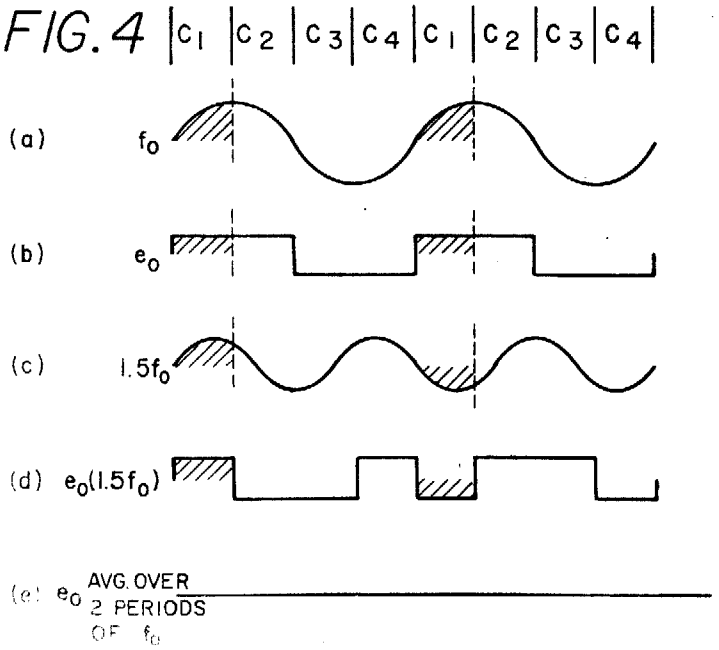
FIG. 4 is a diagramatic representation of output voltages from the commutative filter of FIG. 3 for selected frequencies.

The crystal controlled oscillator 72 drives the 1 to n demultiplexer commutator through the capacitor contacts from "1" to "n" during each frequency cycle. This is graphically demonstrated in FIG. 4 showing the $e_0$ output of the filter for a received frequency of $f_0$, which is the filter response frequency and the frequency of the crystal controlled oscillator. The dc value of each step is determined by the average value of the input wave form during the time that the commutator contacts each capacitor. The four capacitors in each of the six commutative filter sections are switched in sequence at frequency $f_0$. For a received frequency of $f_0$ with the indicated phase relation for example (line "a"), capacitor $c_1$ will charge to the average value of the up going portion of the positive half cycle and capacitor $c_2$ will charge to the average value of the down going portion of the positive half cycle. Similarly, capacitor 3 will charge to the average value of the down going portion of the negative half cycle and capacitor 4 will charge to the average value of the upgoing portion of the negative half cycle. Line b of FIG. 4 illustrates the output voltage corresponding to that portion of the cycle relating to the filter response frequency. When $f_0$ is received, $e_0$ will be the stepped output voltage shown in line b. Thus, signal or noise at frequency $f_0$ passes through the six filter stages with little attenuation and no phase shift.

When the received frequency varies from the filter response frequency $f_0$, the capacitors will charge to an average value of zero. This is demonstrated in lines c and d of FIG. 4 where it is shown that, for a frequency of 1.5 $f_0$, capacitors $c_1$ and $c_2$ will charge to an average value of zero in two cycles of the basic frequency and likewise for capacitors $c_3$ and $c_4$. For example, observing the shaded areas under the curves in FIG. 4, it is seen that $e_0$ (line "b") for $f_0$ (line "a") provides an average output for capacitor $c_1$ that is positive in each cycle, thus, the average value of the output of this component $c_1$ is a whole number. In contradistinction by observing lines c, d and e, it is seen that capacitor $c_1$ charges to an average positive value during its first cycle and to an average negative value of equal magnitude in a second cycle so that $c_0$ averaged over two periods (line "e") provides a zero value. Although it is harder to show this zero average value diagrammatically for frequencies other than 1.5 $f_0$, the charge on the capacitors will nevertheless average out to zero over some period of time. Attenuation and phase shift of noise, at frequency $F_0 \pm \Delta F$ increases with $\Delta F$. The maximum phase shift in one filter section is $\pm 90°$.

This above described property of commutative filters provides a frequency sensitivity that is dependent upon the crystal controlled switching frequency $f_0$ and that is independent of component tolerances or changes thereof due to temperature. In addition, the commutative filter gives control over the filter selectivity (bandwidth) and the filter roll off rate. These controls are independent of each other, independent of the center frequency, and independent of the component changes due to temperature. The filter selectivity is a function of (a) the multiplicity of the capacitors, (b) the value of resistor 71 and (c) the value of the capacitors 74. The roll off rate is a function of the number of filter sections used, with the rate equal to minus 20 decibels per decade per filter section.

The bandwidth of the filter by convention is specified as the 3 db point. The $\Delta F$ of the 3 db point is $1/2\pi NRC$. From this it is seen that the bandwidth of the filter response is dependent upon the RC time constant of the filter of FIG. 3, but that the center frequency ($f_0$) is a function of the high stability of the crystal controlled oscillator as opposed to the lesser stability of the capacitors and resistors in response to temperature changes.

Referring now to FIG. 5 of the drawings, the synchronous detection circuit 53 is shown in greater detail. The synchronous detector 53 functions to look for a phase difference between the signal and noise so that noise coming in within the bandwidth that is being looked for by the filters will be detected to be out of phase with the signal and thereby rejected by the sychronous detection circuit, keeping in mind that noise at $f_0$ will be passed with the signal. Additionally, the synchronous detector sees a phase shift in frequencies outside the filter bandwidth and rejects these frequencies. One traditional technique for synchronous detection is to have a signal going into what may be referred to as a multiplier and have the same signal phase shifted by a network, which phase shifted signal then acts as a control signal for the multiplier. In the present system, the phase shifting network uses a commutative filter section similar to that described above with respect to the commutative filters. The six stages of the commutative filter provide a great deal of filtering on any signals that are off frequency from the frequency of the signal being looked for. However, instead of trying to phase shift the switching signal to the synchronous detector 53, the signal path itself is phase shifted with the control for the phase shift being provided by a switching signal taken from the signal path after the second stage of commutative filtering. This gives the benefit of six stages of commutative filtering in the signal path. By taking the switching signal after the second stage of commuatative filtering, this assures that the switching signal wave form is not totally dependent upon noise but rather provides a fairly clean control signal to synchronously detect the signal emerging from the last four sections of the commutative filter.

The synchronous detector itself is comprised of a commutative filter of multiplicity two which is different from the other sections of the commutative filter where a multiplicity of four is used. Commutative filters with a multiplicity of four are fine for selecting the basic frequency that we are looking for and in rejecting all other frequencies except the harmonics. Filters of a multiplicity of four will not reject any harmonics of the incoming filtered signal. By providing a commutative filter section having a multiplicity of two in the synchronous detector, we provide the system with a capability of rejecting the even harmonics and subharmonics of the basic frequency signal and reduce odd harmonics and subharmonics by a factor corresponding to the order of the harmonic. Thus, a third harmonic will be reduced to $\frac{1}{3}$ of its amplitude. The sync detector thus filters frequencies that the filtering sections themselves are not able to reject. The basic frequency which we are looking for in the system is described as $f_0$ and this is the same frequency that is being provided by the oscillator to drive the commutative filters. A harmonic would be a multiple, for example, twice, three times or four times such $f_0$ and so on. A subharmonic would be half, a third, a fourth, etc. of that $f_0$.

The commutative filter 82 with a multiplicity of two in synchronouus detector 53 is simply an analog switch that switches back and forth between two capacitors. It has an RC time constant, with the incoming signal going through a series resistor 84 into the center pole of the analog switch and with the switch being controlled to first go to one capacitor and then to the other. The switching back and forth of filter 82 is done by a synchronous switching voltage which is derived from the output of the second stage of commutative filtering. The switching signal or switching frequency to this commutative filter comes from the signal itself after the second stage of filtering, with the switching signal passing through a zero crossing detector 81 which outputs a switching signal each time the input wave form crosses zero level, thus, after smoothing to a sinusoidal shape, the zero crossings define the frequency and phase of the synchronous switching voltage. The synchronous switching voltage at frequency $F_0 \pm \Delta F$ causes two capacitors to be alternately charged through a common series resistor connected to the output of the last (6th) filter section. One capacitor is charged by the positive portion of the filter output in phase with the switching voltage and the other capacitor by the negative in-phase component. As the capacitors are alternately connected by the switch, a square wave output is developed at frequency $F_0 \pm \Delta F$. The amplitude of this square wave is a measure of the in-phase component common to the filter output and the switching voltage. At frequency $F_0$, there is no difference in phase between the outputs of the second and sixth filter sections and the amplitude of the synchronous stage output is maximum. With $\Delta F$ large enough to cause $\pm 90°$ phase shift in four filter sections, the output of the synchronous stage is zero. The output is reduced from maximum for $\Delta F$ between these limits. The synchronous stage, with two-capacitor switching completely removes even harmonics and subharmonics of $F_0$ and reduces odd harmonics and subharmonics by a factor 1/n, where n is the order of the harmonic. The synchronous stage has zero output at $F_0 \pm \Delta F$, where $\Delta F$ causes 90° phase shift in four stage of commutative filter. The combination of commutative stages with the synchronous stage results in a filter approaching the ideal form factor, a filter with steep sides, little skirt, and a flat top broad enough to pass the frequencies of a signal pulse. The output of the synchronous detector passes through a buffered amplifier 83 with a high input impedance to eliminate any loading affect of the remainder of the circuitry on the commutative filter section.

In the operation of the synchronous detector, the detector is looking for a phase difference between the signal passing from the last stage of the commutative filter and any noise or other extraneous signals that happen to be in that same frequency band. The six stages of the commutative filter section will eliminate any signals that are outside of the band that we are looking at, but one function of the synchronous detector is contending with the problem of that noise which comes in with the signal at the same frequency as the signal that we are looking at. The partially filtered wave, which comes from after the second stage of the commutative filter section, drives the zero crossing detector to provide an output switching signal which is a square wave and the switching time is thereby determined by when the incoming signal crosses the zero level. Whereas in the commutative filters described above with respect to FIGS. 3 and 4, the filter looked at differences in frequencies using the commutator to look at the average value of discrete portions of a wave form; the synchronous detector uses a similar technique to look at the phase shift between frequencies.

Figure 6:
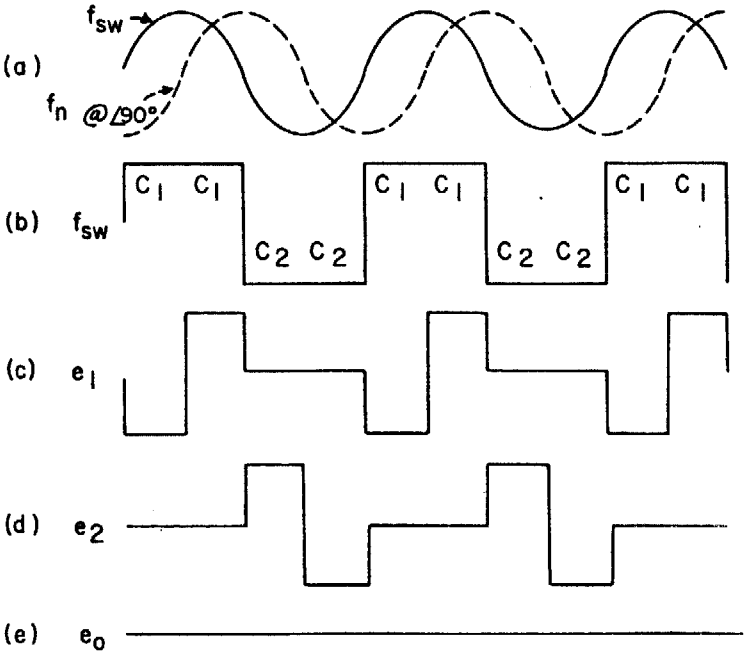
FIG. 6 is a diagramatic representation of output voltages from the synchronous detector of FIG. 5.

Referring now to FIG. 6 of the drawings, line "a" shows the basic frequency $f_0$ as the switching frequency $F_{sw}$ in a solid line. Another line, $f_n$ (noise), represents a signal in the signal path occurring at the same frequency but that is phase shifted 90° from $f_0$ and is shown as a broken line. The commutative filter capacitors $c_1$ and $c_2$ are switched back and forth by $F_{sw}$ ($f_0$) as shown in line "b." The dc value of each step is determined by the average value of the input wave form during the time that the commutator contacts each capacitor. For a received frequency $f_n$, for example, capacitor $c_1$ will always charge to the average value of that portion of the wave form appearing on the commutator at that time, etc. Line "c" shows the charge appearing on $c_1$ for $f_n$ which, for illustrative purposes, is 90° out of phase with $F_{sw}$. In the illustration, the average value of $c_1$ in line "c" as well as $c_2$ in line "d" is zero and, thus, the $e_0$ output (line "e") is zero. Therefore, when the phase of the signal frequency is shifted 90° from that of the switching frequency, the output of the synchronous detector will be zero. The average value of $e_0$ (line "e") for phase shifts other than 90° is reduced, but not to zero as with a 90° phase shift.

Signals $f_0$ which are data components will not be phase shifted as they pass through the synchronous detector and, thus, will provide an output at $e_0$. This is a characteristic of a commutative filter in this application.

The probability of noise entering the synchronous detector at the same frequency and in phase with the center frequency is small.

Figure 7:
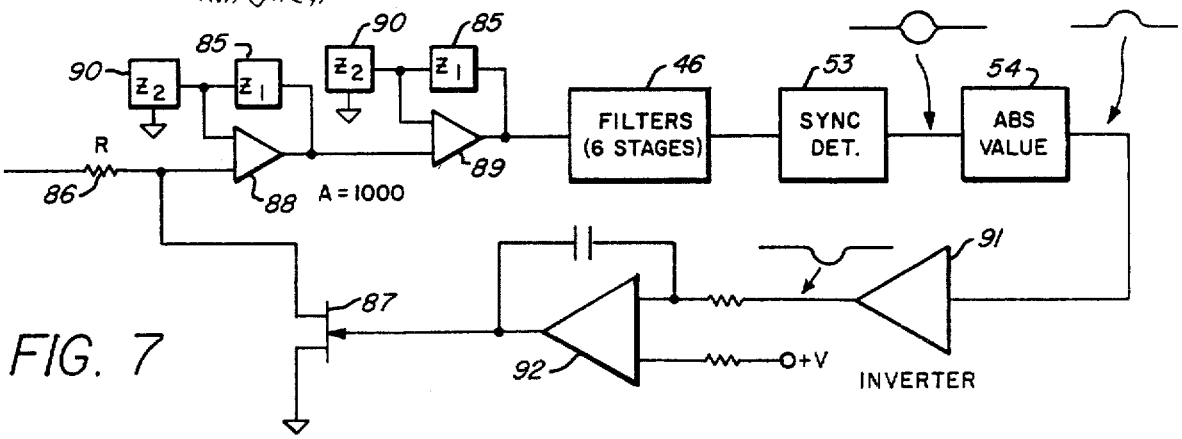
FIG. 7 is a more detailed schematic diagram of the AGC circuit of FIG. 2.

Referring now to FIG. 7 of the drawings, an AGC (automatic gain control) circuit is shown having a series resistor 86 in series with the signal path and FET 87 that shunts the signal path. The resistance of the FET can be controlled, thereby controlling the amount of attenuation of the signal. Following that are two stages of amplification 88 and 89 which establish the maximum gain of the AGC.

The amplifier stages are non-inverting gain configurations which include gain determining impedances that are a function of frequency. For example amplifier stage 88 has a $Z_1$ impedance network 85 between its output and its inverting input. An additional $Z_2$ impedance network 90 is placed in the circuit between the inverting input and ground. The same impedance networks are provided for amplifier 89. In the operation of the AGC circuit, the gain of the amplifiers 88 and 89 is determined by the frequency response of the impedances of networks 85 and 90. The gain equation for the amplifiers 88 and 89 is $A=1+(Z_1/Z_2)$. If you allow the impedance of $Z_1$ to decrease as the frequency increases and allow $Z_2$ to increase as frequency decreases, then the overall gain response is analogous to a broad band filter. The bandwidth of the filter is established by the 3 db roll off point of the impedances $Z_1$ and $Z_2$. With the use of such gain determining impedance networks, gain is not applied over the entire frequency spectrum received, but rather only to a relatively narrow band of frequencies including any of the precise frequencies ($f_0$) to be used by the system.

Included in the feedback loop of the AGC circuit are the commutative filters 46 and the absolute value circuit 54. The wave form emerging from the filters is in the shape of the eye as shown in FIG. 5. This wave form passes through the absolute value circuit 54 with all of the negative portion of the signals inverted. The inverter 91, which follows the absolute value circuit, inverts the remaining signal to give it the correct level for application to the field effect transister 87 which requires a negative voltage to turn it off.

An AGC integrator 92 in the feedback loop has a very long time constant in the order of about 10 seconds. The purpose for this is that the signals coming into the integrator occur every time a data 1 is in the bit stream. If it were not for the long time constant, every time a data bit time occurred, the feedback loop would output and would change the gain of the AGC appreciably. It is preferable to present a normalized signal to the commutative filters, the gain of which is not changing as the result of every bit of data that comes in. Therefore, by having a long time constant, it takes several data 1's into the AGC integrator before the DC output level of that integrator changes. Additionally, if the time constant on the AGC integrator were small a noise burst would also have more of an affect upon the gain of the AGC. However, since the feedback loop to the AGC circuit comes after all of the filtering, most of the noise outside of the band that we are looking for is rejected. Noise that does come within the band will affect the gain of the AGC. That amount of noise is small compared to the total noise available in the entire spectrum.

The above described system of filtering the AGC control loop signal allows the system to lock onto the strongest signal passing through the AGC. One advantage that such a system affords is a less likelihood of inadvertent lock-on of the system to noise occurring at the precise frequency being utilized to transmit data. This in turn facilitates the use of a single frequency within the system, with repeaters receiving and sending at the same frequency. For example, if the AGC were not controlled by a filtered controller and was rather controlled by its own output, noise within the system would control the AGC, since noise in the present environment is generally greater than the signal. Thus, the AGC would establish a certain output level as defined by how much noise arrived at its input. Buried in such noise, you could have a signal from the closest repeater station and another signal from a repeater station spaced further away with the latter being a weaker signal. The system could still lock onto the weaker signal and would stay locked onto it because there would be no controlling means to pull it away from such weaker signal, since the AGC gain would be controlled by noise.

On the other hand, where as in the present system, filtering takes place within the control loop of the AGC, the AGC gain is controlled by signal. Assume then that the system locks onto the weaker signal as in the example above. The time delay between the two signals arriving at the AGC from close and further away repeaters is fairly small, for example, on the order of 100 milliseconds. If the system locks onto the weaker signal, the stronger signal will appear approximately one-tenth of a second later. Since the AGC integrator has a long time constant or window encompassing the one-tenth second time span, the window will see the stronger signal and, as a result, shift its locking point from the weaker signal to the stronger signal, thus the control for the AGC will be a function of the stronger signal. As seen from the above example, a result of this AGC capability is a greater capability to use a single frequency system as opposed to the multiple frequency system generally described throughout this specification.

The output of the AGC integrator is a DC level and that DC level changes with the accumulation of incoming data pulses. Because the integrator is operated essentially open loop, it will compensate for any parametric changes in the FET 87 or in any of the other components throughout the entire loop. For instance, if the threshold voltage of the FET 87 were to change, that is, the threshold voltage for example lowered as a result of temperature changes, then the device would momentarily go into a heavier conduction so it would attenuate the incoming signal more. Such attenuation of the signal would in turn feed back to the AGC integrator and thereby cause the output voltage of the AGC integrator to lower by the same amount that the threshold of the FET device changed. This would bring the FET 87 back to its normal level that existed before the temperature change occurred. By having the AGC within a closed loop such as this, any parametric changes due to temperature or time or deterioration of a device are compensated by the closed loop.

Figure 8:
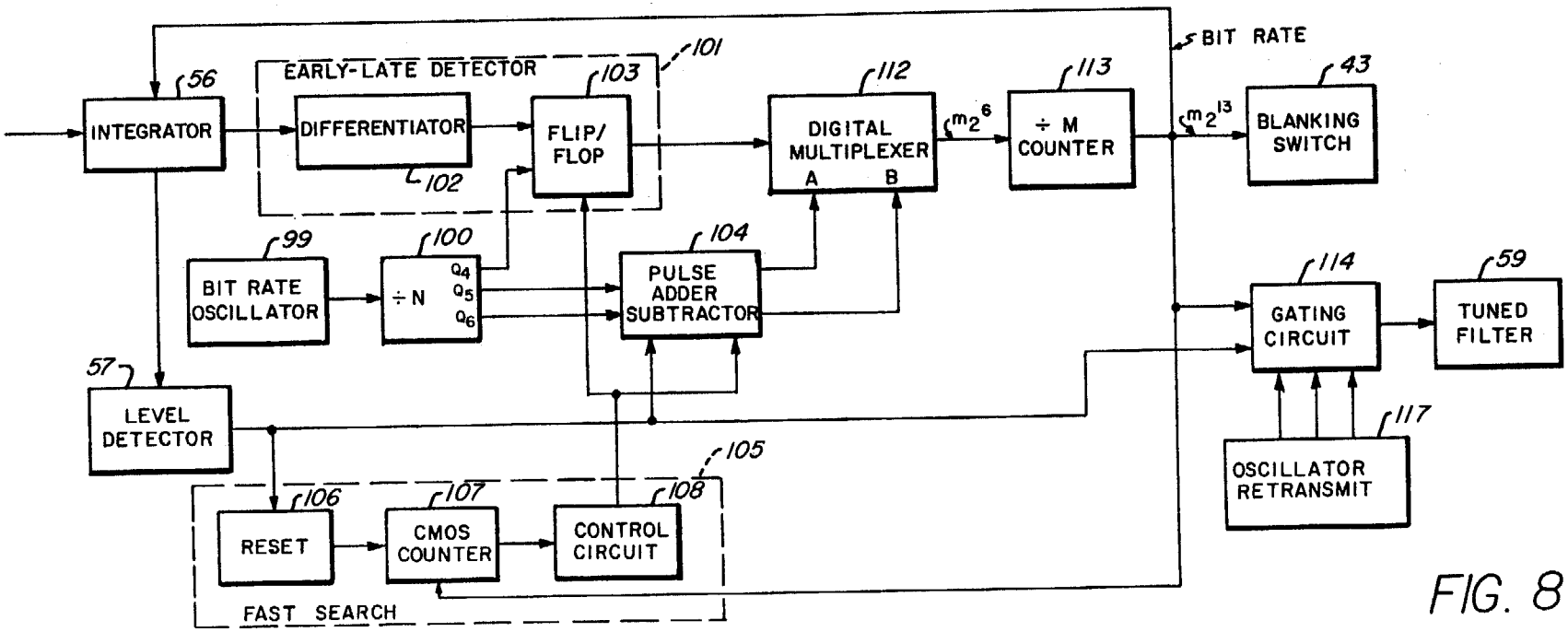
FIG. 8 is a more detailed schematic diagram of the bit rate clock circuit of FIG. 2.

Referring next to FIG. 8 of the drawings, the digital implementation of a clock, referred to in FIG. 2 as Bit Rate Clock 58, consists of essentially four different functions which were mentioned earlier. These are an early-late detector, a fast search mode, the bit rate clock itself and an oscillator retransmit section. The data stream that is passed by the integrator 56 goes to early-late detector 101 which is comprised of a differentiator 102 and flip flop 103. The early-late detector compares the data bit to a clock signal and then provides a signal from the output of the flip flop 103 to a digital multiplexer 112. Other A and B inputs to the digital multiplexer 112 are passed from a pulse adder-subtractor 104 which is digitally phase shifting the output of a crystal oscillator 99 and divide by "N" counter 100. The crystal oscillator 99, divide by "N" 100, pulse adder-subtractor 104, digital multiplexer 112, and a divide by "M" counter 113 provide the clock function of the bit rate clock 58 to output a bit rate. The crystal oscillator 99 operates at substantially the same frequency as the transmitter clock that generates the incoming data stream to the circuit. Because the tolerance on the crystal oscillator 99 is stable over temperature variations, these two crystal oscillators will operate at very close frequencies and will stay in such close operation for a long period of time. Therefore, the synchronization function of the bit rate clock is only to make small corrections that maintain the two clocks in full synchronization at all times. Control circuitry as will be hereinafter described for maintaining these small corrections need only shift the bit rate clock very small amounts. Therefore, the chances of the clock being shifted completely out of synchronization is unlikely. The early-late detector 101 compares the two inputs, that is, the bit rate within the local crystal oscillator 99 and divide by "N" 100 and the received data stream. The early-late detector then determines whether or not the received data stream comes within the window that the local bit rate clock is looking for. If the window is opened too early, then a correction will be made such that the window will be opened up a little bit later for the next incoming data stream. The window in this situation is the integrator 56 which receives its control signal from the bit rate clock 58. Essentially, the bit rate clock knows when a received data bit should be coming in so it opens up the window in the integrator at the time that it is supposed to be receiving a data bit. If a data bit is received during that window time, it would have passed through all the filtering, synchronous detection and integrator, and would be an output of the integrator itself. The same data stream output that passes from the integrator to the differentiator 102 also is detected by the level detector 57 when it goes high as a result of a signal output or data "one" for passage to the pulse adder-subtractor and to a reset circuit 106 in a fast search circuit 105. The other signal from the integrator which passes directly to the differentiator 102 in the form of a data bit is looked at by the early-late detector. The differentiator 102 differentiates the signal and passes it to a flip flop 103. The flip flop 103 compares the signal with the output of the crystal oscillator and divide by "N" counter to determine if the output of the integrator is early or late with respect to the output of the bit rate clock. If the pulse is early, this means that the integrator window was opened too late so a feedback signal from the bit rate clock to the integrator opens the window of the integrator earlier for reception of the next data bit.

This shifting of the window in the integrator is accomplished by adding and subtracting a pulse to the bit rate oscillator input to adder subtractor 104 and then by means of the early-late detector, selecting one of these modified signals to serve as the bit rate. The digital multiplexer 112 receives an A and B input from adder-subtractor 104, one of which is the bit rate oscillator with one pulse added and the other of which is the bit rate oscillator with one pulse subtracted. The addition or subtraction of that one pulse will shift the phase of the clock less than one percent, or in other words, a very small correction. This adding and subtracting of a pulse to the bit rate oscillator is accomplished every time a data "one" is received because this comparison is continuously made to see if the received data bit is early or late. The input to the adder-subtractor 104 from level detector 57 tells the adder-subtractor when a data "one" is received. The digital multiplexer will always shift the bit rate clock one pulse in one direction or the other; that is, it will always add or subtract a pulse.

The bit rate oscillator 99 output is multiplied in the divide by "N" 100 counter circuitry to provide two outputs to pulse adder-subtractor. The $Q_5$ output of divide by "N" 100 is a timing clock to operate the adder-subtractor. $Q_6$ output is a divided down bit rate oscillator to which pulses are added and subtracted for passage to the A and B inputs of digital multiplexer 112. The level detector 57 signal to the pulse adder-subtractor is a signal that tells the adder-subtractor to add or subtract i.e., that a data bit or "one" is being received.

In this respect, if a pulse is added and the addition of that pulse pulls the bit rate clock the wrong way or slightly out of synchronization, then the next time the circuit will subtract from that signal and correct it. This of course would be true with any noise that comes in. If noise activates the bit rate clock, by the very nature of noise, the average value of the shifting early and late should always be zero. Although there is a continuous jittering affect going on due to this add and subtract network, the overall effect is that the bit rate clock is fully synchronized with the clock that is controlling the transmission of the incoming data stream.

Another section of the bit rate clock circuit is that of the fast search mode 105. The fast search mode finds particular application when the system is first powered up. At that time it is possible that the crystal oscillator 99 and the oscillator clock of the incoming data transmission would be completely out of synchronization and therefore incapable of providing useful data. As a result, because the bit rate clock makes such small corrections each time from the control of the early-late detector and the pulse adder-subtractor, a large desynchronization of the clocks would prevent the bit rate clock from ever seeing data. This is because the window of the integrator would be opened entirely at the wrong time. In that event, the early-late detector would be essentially controlled by noise and it would continue to jitter back and forth with no net shift in synchronization. The possibility would exist in that case that the two clocks would never synchronize or that it would take a very long time before the two clocks would be synchronized if they started out completely out of synchronization.

The fast search mode, therefore, looks at the bit rate being generated by the bit rate clock by means of a feedback loop from the divide by "M" counter 113 to a CMOS counter 107 in the fast-search circuitry. The counter 107 determines whether data is received during a predetermined number of bit times and if no data is received during that period of time, it will cause the bit rate clock to shift continuously in one direction instead of allowing the noise to take over and shift the bit rate clock back and forth. When the counter 107 does not see a data bit for the predetermined period of time, it passes a signal to a gate control circuit 108 which in turn controls the early-late detector and pulse adder-subtractor portion of the bit rate clock to run in a single direction until the output of the bit rate clock passing back to the integrator 56 catches up with the incoming data stream to provide a synchronous window. At that time, the fast search mode drops out of operation, and the early-late function takes over again. The drop out of the fast search mode is accomplished by passing a data signal from the level detector 57 to a reset circuit 106 in the fast search circuitry. When the integrator passes a data signal through the level detector to the reset 106, the fast search mode recognizes the data signal and thereby recognizes that the bit rate clock has caught up and is getting data at the time that the integrator window is opened. At this time the fast search mode ceases functioning to let the early-late circuitry continue its controlling operation.

The fast search circuitry has two inputs, the input of the received data stream from the level detector 57 and the input from the bit rate clock itself. CMOS binary counter 107 within the fast search circuitry counts X number of bit times. Every time the bit rate clock says that there should be a data bit at this time, the counter 107 will clock that. If it has not received any valid data for X number of counts, control circuit 108 passes a signal to flip flop 103 to cause the early-late circuitry logic to think that the received data is early. The output of the control circuit sets the flip flop in that one state regardless of what the data input coming into the flip flop is. It thereby forces the flip flop into the one state to continuously tell the digital multiplexer that the data bit is early. Control circuit 108 also passes a data stream signal to the pulse adder-subtractor in place of the data "ones" which would normally be incoming from level detector 57 to provide a signal to the adder-subtractor that acts as a false data "one" for continuously operating the adder-subtractor in the fast search mode.

Referring again to the early-late detector, differentiator 102 is looking at the output of integrator 56, which is an integrated signal that rises with an RC time constant. The signal then rounds off and tends to flatten out when there is no more rising signal available to it. This rounding off and flattening out occurs prior to the reset of the integrator with the output of the integrator going to zero at the integrator reset time. The differentiator is essentially looking at this inflection point in the signal. When the integrator output starts to round off and flatten out, that inflection point is what the differentiator is looking for. The output of the differentiator triggers at that point. Flip flop 103 which generates the logic that tells the circuit whether the signal is early or late, looks for that transition output of the differentiator and compares it to a known time instant (representing the center of the time window) which it receives from the divide by "N" counter 100. The incoming signal from the integrator should be at its maximum level in the middle of the time window. When that maximum level coincides with the inflection point in the integrator output, then the two signals are in synchronization. Thus the flip flop compares the output of the differentiator with the clocking signal coming to it from the divide by "N" 100 to determine whether the divide by "N" signal is in the middle of the window or whether it is on one side of the window or the other. Logic level that is outputted from the flip flop 103 corresponds to whether the signal was input early or late to control the digital multiplexer 112 respectively. The digital multiplexer 112 then selects an A or B input from the pulse adder-subtractor 104. The A input from pulse adder-subtractor 104 has clock transitions added to it whereas the B input from adder-subtractor 104 has a clock transition subtracted from it. If the signal is early then the digital multiplexer will select which ever input it needs in order to provide a subtracted pulse on its output. If the signal however, is late the multiplexer will select the other input so that it is continuously selecting either A or B inputs from the adder-subtractor. Therefore, the multiplexer is selecting the bit rate oscillator that has either had a clock bit added to it or a clock bit subtracted from it. The output of level detector 57 passes to the adder-subtractor 104 in order that the bit may be added or subtracted from the pulse stream and then passed to the digital multiplexer. Thus one or the other of the A or B streams is selected for passage onto the circuit as the bit rate clock.

The output of the digital multiplexer 112 is a modified clock because its output has had pulses either added or subtracted to it. This output is passed to the divide by "M" counter 113 which simply divides the clock frequency down to the bit rate clock. Since the input to the divide by "M" counter is a modified clock, it is essentially just a synchronized clock. The divider chain does not loose any of the synchronization but merely divides down to the operational bit rate, which is a frequency lower than the frequency of the modified clock.

The output signal of the bit rate clock is passed to a retransmitting circuit and at the same time to the blanking switch 43. Therefore as the circuit retransmits this signal at a different frequency, the blanking switch serves to blank off the remaining circuitry behind it so that the circuitry is not saturated by the high voltage transmitted signal to the drill string. The output of the bit rate clock is also passed to gating circuit 114 which allows the transmission of a given frequency from the high frequency oscillator 117 for a specified length of time and only during those times that the bit rate clock says that a "one" should be retransmitted. This is accomplished by providing an output from the level detector 57 to the gating circuit 114 to control passage of an output to tuned filter 59 only when data "ones" are received.

While particular embodiments of the present invention have been shown and described, it is apparent that changes and modifications may be made without departing from this invention. For example, the system has been disclosed for the most part as providing a data signal transmission from downhole to the surface. It is readily seen that sending signals from the surface downhole would be useful. An additional example of such a change or modification would reside in using the system to transmit and retransmit at a single frequency. While for the most part the system is described as using a mix of frequencies to provide directional isolation, it is possible to utilize a single frequency with or without repeaters. In any event, it is the aim of the appended claims to cover all such changes and modifications as fall within the true spirit and scope of this invention.

What is claimed is:

1. In a borehole telemetry system for passing acoustic signals in the form of a data stream over an elongated column acting as an acoustic path in the borehole, such acoustic signals having a data component embedded in a high level of noise, circuit means for filtering noise from the signal to provide a useable data component, which means comprises:

first commutative filter means for filtering noise components of the data stream which occur at frequencies outside a narrow frequency band;

second commutative filter means for sequentially measuring the amplitude of a discrete portion of the data stream after the frequency filtering, said first commutative filter means further providing means for phase shifting noise components of the data stream before passage of the data stream into the second commutative filter means;

means for operating the sequential measuring means in timed relation to the occurrence in the data stream of a switching signal occurring at a selected frequency; and means for outputting the average value of discrete portions of the data stream.

2. Apparatus of claim 1 and further wherein said phase shifting means has a plurality of stages of commutative filters.

3. The apparatus of claim 2 wherein said switching signal is taken from the data stream after the data stream has passed through only a portion of the plurality of phase shifting stages of commutative filters.

4. The apparatus of claim 1 where said second commutative filter means for sequential measuring is a commutative filter of multiplicity two and said first commutative filter means is a series of commutative filters having a multiplicity greater than two.

5. The apparatus of claim 1 wherein said means for operating said second commutative filter means is a zero crossing detector.

6. The apparatus of claim 2 wherein said phase shifting means are commutative filters for removing noise components occurring at frequencies other than a selected discrete frequency.

7. The apparatus of claim 6 wherein a signal for operating said zero crossing detector is the data stream after it has passed through at least one stage of commutative filtering to eliminate frequencies in the data stream occurring at other than said selected discrete frequency.

8. The apparatus of claim 1 wherein the means for operating the second commutative filter for sequential measuring is a switch means operated by a signal occurring at a selected frequency in the data stream and outputting a switching signal when the data stream signal crosses the zero level.

9. The apparatus of claim 1 wherein said average value outputting means includes a plurality of capacitors sequentially charged by means of a commutative contact driven in synchronization with the rise and fall of the data stream at a selected frequency, such charge representing the DC value of that discrete portion of the data stream.

10. The apparatus of claim 1 and further including an amplifier in the output of the circuit means for increasing the gain of the data stream after the filtering out of frequency components in the data stream which occur out of phase with the data component of the data stream.

11. In apparatus including a synchronous detector for use in a borehole telemetry system to detect a phase shift in acoustic signals being passed at a precise frequency over an elongated column acting as an acoustic signal path in a borehole, such acoustic signal having a data component embedded in a high level of noise, circuit means for filtering noise from the signal to provide a useable data component, which means comprises:

first commutative filter means having a plurality of filter stage for eliminating noise components from the acoustic signal occurring at frequencies other than at a discrete center frequency of said first commutative filter means;

second commutative filter means for sequentially measuring a parameter of discrete portions of the acoustic signal after it has passed through n stages of first commutative filter means;

clock means for operating said sequential measuring means;

said sequentially measured signal having been phase shifted by said first commutative filter means with respect to said clock means; and means for outputting the average value of the discrete portions of the measured parameter.

12. The apparatus of claim 11 wherein said clock means is operated by the acoutic signal before it has passed through all the stages of the commutative filter means, the additional stages of commutative filters serving to phase shift noise components of the acoustic signal passing into said second commutative filter means.

13. A method for synchronously detecting a noise component in an acoustic telemetry data stream to transmit a useable data component of the data stream over an elongated column in a borehole, including the steps of:

passing the data stream through a phase shifting network of a plurality of stages of commutative filters for phase shifting the noise component of the data stream;

operating another commutative filter as a synchronous detector to charge a sequence of capacitors to the average value of a discrete portion of the data stream occurring at a precise frequency;

clocking the operation of the another commutative filter by means of detecting a parameter of the data stream before it has passed through all of the stages of the commutative filter phase shifting network.

14. The method of claim 13 wherein such commutative filter phase shifting network is a plurality of commutative filters, and further including operating such filters to pass only frequencies occurring within a narrow bandwidth.

15. The method of claim 13 and further including utilizing the rise and fall of the acoustic signal to clock the operation of the synchronous detecting commutative filter.

16. In a borehole telemetry system for passing acoustic signals in the form of a data stream over an elongated column acting as an acoustic path in the borehole, such acoustic signals having a data component embedded in a high level of noise, circuit means for filtering noise from the signal to provide a useable data component, which means comprises:

means for sequentially measuring the amplitude of a discrete portion of the data stream;

commutative filter means for phase shifting noise components of the data stream before passage of the data stream into the sequential measuring means, said phase shifting commutative filter means having a plurality of stages comprised of a series of commutative filters;

means for operating the sequential measuring means in timed relation to the occurrence in the data stream of a switching signal occurring at a selected frequency, said switching signal being taken from the data stream after the data stream has passed through only a portion of the plurality of phase shifting stages; and means for outputting the average value of discrete portions of the waveform of the signal path.

17. In a borehole telemetry system for transmitting acoustic signals over an elongated column acting as an acoustic path in the borehole, said acoustic signals having a data component embedded in a noise background, circuit means forming a circuit path to receive and retransmit said acoustic signal and for maintaining a precise frequency for said acoustic signal transmission, which means comprises:

means for detecting an acoustic signal in the elongated column;

means for amplifying the data component of the detected signal, said amplifier means having a feedback control;

means receiving the amplified signal for filtering noise from the acoustic signal, which noise is at a frequency other than the precise frequency of the data component, said filtering means being comprised of a plurality of commutative filters in series;

means in the circuit path for passing a feedback control signal to said amplifying means, said control signal being derived from the signal path after filtering has taken place;

means in the circuit path receiving the filtered signal for detecting a phase shift in frequencies outside the precise frequency, said phase shift detecting means being clocked by the acoustic signal after it has passed through less than all of said commutative filters; and means for retransmitting the data component of the acoustic signal at a precise frequency.

18. The system of claim 17 wherein said phase shift detecting means is also a commutative filter having a multiplicity different from the multiplicity of said commutative filters comprising said filtering means.

19. The system of claim 18 wherein said amplifying means is an AGC circuit receiving a gain control signal from the signal path after the acoustic signal has passed through said filtering means and said phase shift detecting means.

* * * * *